US011408203B2

(12) United States Patent
Carpenter et al.

(10) Patent No.: US 11,408,203 B2
(45) **Date of Patent: *Aug. 9, 2022**

(54) ACCESS CONTROL DEVICE

(71) Applicant: Schlage Lock Company LLC, Carmel, IN (US)

(72) Inventors: John C. Carpenter, Ingalls, IN (US); William B. Ainley, Carmel, IN (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/075,301

(22) Filed: Oct. 20, 2020

(65) Prior Publication Data

US 2021/0102404 A1 Apr. 8, 2021

Related U.S. Application Data

(60) Continuation of application No. 16/451,471, filed on Jun. 25, 2019, now Pat. No. 10,808,423, which is a (Continued)

(51) Int. Cl.
*E05B 47/06* (2006.01)
*E05B 65/10* (2006.01)

(Continued)

(52) U.S. Cl.
CPC ..... *E05B 47/0012* (2013.01); *E05B 47/026* (2013.01); *E05B 47/0673* (2013.01);

(Continued)

(58) Field of Classification Search
CPC ..... E05B 47/026; E05B 47/0673; E05B 65/1053; E05B 2047/0073;

(Continued)

(56) References Cited

U.S. PATENT DOCUMENTS 3,428,033 A 2/1969 Watts
3,677,043 A 7/1972 Cox (Continued)

FOREIGN PATENT DOCUMENTS

WO 2001042594 A2 6/2001
WO 2007125163 A1 11/2007

(Continued)

OTHER PUBLICATIONS

International Search Report; International Searching Authority (US); International PCT Application No. PCT/US2015/018066; dated Jul. 21, 2015; 4 pages.

(Continued)

*Primary Examiner* — Brian E Miller
(74) *Attorney, Agent, or Firm* — Taft Stettinius & Hollister LLP

(57) ABSTRACT

An access control device generally includes an electromechanical actuator operable to transition the access control device between a locked state and an unlocked state, an energy storage device operable to store electrical power from a power supply, and control circuitry. The control circuitry is configured to direct a first electrical power from the energy storage device to the electromechanical actuator in response to one or more first criteria. In a fail secure mode, the first electrical power is configured to cause the electromechanical actuator to transition the access control device to the locked state. In a fail safe mode, the first electrical power is configured to cause the electromechanical actuator to transition the access control device to the unlocked state. Certain embodiments further include a user-adjustable switch operable to transition the control circuitry between the fail secure mode and the fail safe mode.

15 Claims, 5 Drawing Sheets

Related U.S. Application Data continuation of application No. 15/669,354, filed on Aug. 4, 2017, now Pat. No. 10,329,800, which is a continuation of application No. 15/248,450, filed on Aug. 26, 2016, now Pat. No. 9,725,926, which is a division of application No. 14/194,605, filed on Feb. 28, 2014, now Pat. No. 9,435,142.

(51) Int. Cl.

| | |
|---|---|
| ***E05B 47/02*** | (2006.01) |
| ***E05B 55/00*** | (2006.01) |
| ***E05C 1/12*** | (2006.01) |
| ***E05B 47/00*** | (2006.01) |

(52) U.S. Cl.

CPC ..... *E05B 55/00* (2013.01); *E05B 65/1053* (2013.01); *E05C 1/12* (2013.01); *E05B 2047/0023* (2013.01); *E05B 2047/0057* (2013.01); *E05B 2047/0058* (2013.01); *E05B 2047/0059* (2013.01); *E05B 2047/0073* (2013.01); *E05B 2047/0076* (2013.01); *E05B 2047/0094* (2013.01); *Y10T 70/7062* (2015.04)

(58) Field of Classification Search

CPC ..... E05B 2047/0094; E05B 2047/0023; E05B 2047/0057; E05B 2047/0059; E05B 2047/0076; E05B 2047/0058; E05B 47/0012; Y10T 70/7062; G07C 2009/00269; G07C 9/00031; G07C 9/00134; G07C 9/00182; G07C 9/00309; G07C 9/00857; G07C 2009/00603; G07C 2009/00611; G07C 2009/00619; G07C 2009/00626; G07C 2009/00634; G07C 2009/00642; G07C 2009/0065; G07C 2009/00746; G07C 9/00658; G07C 9/00666; G07C 9/00674; G07C 9/00682; G07C 9/0069; G07C 9/00698; G07C 9/00706; G07C 9/00714; G07C 9/00722; G07C 9/0073; G07C 9/00738

See application file for complete search history.

(56) References Cited

U.S. PATENT DOCUMENTS

| | | | | |
|---|---|---|---|---|
| 3,750,005 | A | 7/1973 | Downes, Jr. et al. | |
| 4,875,722 | A | 10/1989 | Miller et al. | |
| 5,372,394 | A | 12/1994 | Salter et al. | |
| 5,628,216 | A | 5/1997 | Quereshi et al. | |
| 5,656,899 | A | 8/1997 | Kuroda | |
| 5,800,461 | A | 9/1998 | Menken et al. | |
| 5,876,073 | A | 3/1999 | Geringer et al. | |
| 5,896,025 | A | 4/1999 | Higgins | |
| 6,020,724 | A | 2/2000 | O'Loughlin | |
| 6,038,896 | A * | 3/2000 | Chamberlain | E05B 47/0012 70/277 |
| 6,104,594 | A | 8/2000 | Frolov et al. | |
| 6,125,047 | A | 9/2000 | Janz | |
| 6,912,136 | B2 | 6/2005 | Thrap | |
| 7,113,070 | B2 | 9/2006 | Deng et al. | |
| 7,231,791 | B2 | 6/2007 | Sakai | |
| 7,246,827 | B2 | 7/2007 | Geringer et al. | |
| 7,614,669 | B2 | 11/2009 | Geringer et al. | |
| 7,698,918 | B2 | 4/2010 | Geringer et al. | |
| 7,862,091 | B2 | 1/2011 | Escobar | |
| 7,963,574 | B2 | 6/2011 | Geringer et al. | |
| 8,047,582 | B1 * | 11/2011 | Rodgers | E05B 65/0007 292/201 |
| 8,051,689 | B1 | 11/2011 | Shen et al. | |
| 8,222,990 | B2 | 7/2012 | Gerner et al. | |
| 8,376,416 | B2 | 2/2013 | Arabia, Jr. et al. | |
| 8,683,833 | B2 | 4/2014 | Marschalek et al. | |
| 9,019,067 | B2 | 4/2015 | Bryla et al. | |
| 9,041,510 | B2 | 5/2015 | Wolski | |
| 9,151,079 | B2 | 10/2015 | Webb et al. | |
| 9,181,730 | B1 | 11/2015 | Peng | |
| 9,273,489 | B2 | 3/2016 | Hickman | |
| 9,316,022 | B2 | 4/2016 | Tyner et al. | |
| 9,340,998 | B2 | 5/2016 | Mani et al. | |
| 9,435,142 | B2 * | 9/2016 | Carpenter | E05B 65/1053 |
| 9,435,143 | B2 | 9/2016 | Shen | |
| 9,725,926 | B2 * | 8/2017 | Carpenter | E05B 47/0673 |
| 10,329,800 | B2 * | 6/2019 | Carpenter | E05B 47/026 |
| 10,808,423 | B2 * | 10/2020 | Carpenter | E05B 47/0012 |
| 2003/0089826 | A1 | 5/2003 | Barba | |
| 2008/0289377 | A1 * | 11/2008 | Alef | E05B 47/02 70/280 |
| 2010/0031714 | A1 * | 2/2010 | Brown | G07C 9/00896 70/91 |
| 2010/0123323 | A1 | 5/2010 | Geringer et al. | |
| 2010/0294008 | A1 | 11/2010 | Bogdonov et al. | |
| 2012/0169453 | A1 | 7/2012 | Bryla et al. | |
| 2013/0000366 | A1 | 1/2013 | Martel et al. | |
| 2013/0093503 | A1 | 4/2013 | Kok et al. | |
| 2015/0184425 | A1 * | 7/2015 | Ellis | E05C 1/08 292/144 |
| 2015/0240529 | A1 | 8/2015 | Dore Vasudevan et al. | |
| 2015/0247345 | A1 | 9/2015 | Carpenter et al. | |
| 2016/0258189 | A1 * | 9/2016 | Frolov | E05B 47/026 |
| 2016/0307681 | A1 * | 10/2016 | Shaffer | G07C 9/00309 |

FOREIGN PATENT DOCUMENTS

| | | | |
|---|---|---|---|
| WO | 2013112043 | A1 | 8/2013 |
| WO | 2013168114 | A1 | 11/2013 |
| WO | 2014028332 | A1 | 2/2014 |

OTHER PUBLICATIONS

Written Opinion of the International Searching Authority; International Searching Authority (US); International PCT Application No. PCT/US2015/018066; dated Jul. 21, 2015; 6 pages.

Von Duprin Door Control and Security Hardware Catalog, 2005 Ingersoll-Rand Form VD-GN-1009, Rev. Jul. 2005 USA; 36 pages.

Maxwell Technologies, Charging of Ultracapacitors, Document 1008981 Rev 1, Dec. 2005 USA; 5 pages.

Canadian Office Action; Canadian Intellectual Property Office; Canadian Patent Application No. 2,944,144; dated Oct. 2, 2017; 4 pages.

* cited by examiner

ACCESS CONTROL DEVICE

CROSS REFERENCE TO RELATED APPLICATIONS

The present application is a continuation of U.S. patent application Ser. No. 16/451,471 filed Jun. 25, 2019 and issued as U.S. Pat. No. 10,808,423, which is a continuation of U.S. patent application Ser. No. 15/669,354 filed on Aug. 4, 2017 and issued as U.S. Pat. No. 10,329,800, which is a continuation of U.S. patent application Ser. No. 15/248,450 filed on Aug. 26, 2016 and issued as U.S. Pat. No. 9,725,926, which is a divisional of U.S. patent application Ser. No. 14/194,605 filed on Feb. 28, 2014 and issued as U.S. Pat. No. 9,435,142, the contents of each application incorporated herein by reference in their entirety.

TECHNICAL FIELD

The present invention generally relates to electronic locks, and more particularly, but not exclusively, to electronic locks with rapid charging of an energy storage device and/or a selectable power off function.

BACKGROUND

Present approaches to electrified locks suffer from a variety of drawbacks, limitations, disadvantages and problems including mode selection, power consumption, and others. For example, certain standards and certifications dictate that an electric locking system operate in a fail-secure mode. In the fail-secure mode, the lock must remain locked, or transition from an unlocked state to the locked state in the event of power failure. Certain consumers, however, prefer locking systems operable in a fail-safe mode. In the fail-safe mode, the lock must remain unlocked, or transition from the locked state to the unlocked state in the event of power failure.

Certain conventional systems provide fail-safe and/or fail-secure functionality by utilizing a solenoid including a plunger movable between locking and unlocking positions. When power is applied to the solenoid, the plunger extends, causing the system to change locking states. When power is removed, a spring returns the plunger to its original position, and the lock returns to its idle state.

When such conventional systems are operating in the fail-secure mode, the solenoid is normally not energized, and the plunger is spring-biased to a locking position. To unlock the lock, power is supplied to the solenoid for a predetermined amount of time, moving the plunger to an unlocking position against the force of the spring. Once the power is cut, the spring returns the plunger to the locking position. Because providing electricity to the solenoid unlocks the system, the fail-secure mode is occasionally referred to as an electric unlocking (EU) mode.

When such conventional systems are operating in the fail-safe mode, the solenoid is constantly energized to retain the plunger in a locking position. To unlock the lock, the power is removed from the solenoid for a predetermined amount of time, during which time a biasing spring moves the plunger to an unlocking position. Because providing electricity to the solenoid locks the system, the fail-safe mode is occasionally referred to as an electric locking (EL) mode.

In addition to the relatively high cost of solenoids, the requirement that power be continuously applied to retain the plunger in the locking or unlocking position makes such conventional systems inefficient and costly to operate. There is a need for the unique and inventive locking apparatuses, systems and methods disclosed herein.

SUMMARY

An illustrative access control system includes a locking assembly operable in locked and unlocked states, and a drive assembly operable to actuate the locking assembly. The drive assembly includes an electromechanical actuator, and energy storage device, and a control system. The electromechanical actuator is operable, upon receiving power, to transition the locking assembly between the locked state and the unlocked state. The energy storage device is electrically coupled to the electromechanical actuator, and configured to store electrical power from the power supply when the drive assembly is coupled to the power supply. The control system is configured to couple the drive assembly to the power supply in response to a first condition, and to thereafter transmit energy only from the energy storage device to power the electromechanical actuator, based at least in part upon a level of energy stored in the energy storage device. The lock assembly may also include a selectable power off function. Other embodiments include apparatuses, systems, devices, hardware, methods, and combinations for an electronic lock. Further embodiments, forms, features, aspects, benefits, and advantages of the present application shall become apparent from the description and figures provided herewith.

DETAILED DESCRIPTION OF ILLUSTRATIVE EMBODIMENTS

Figure 1:
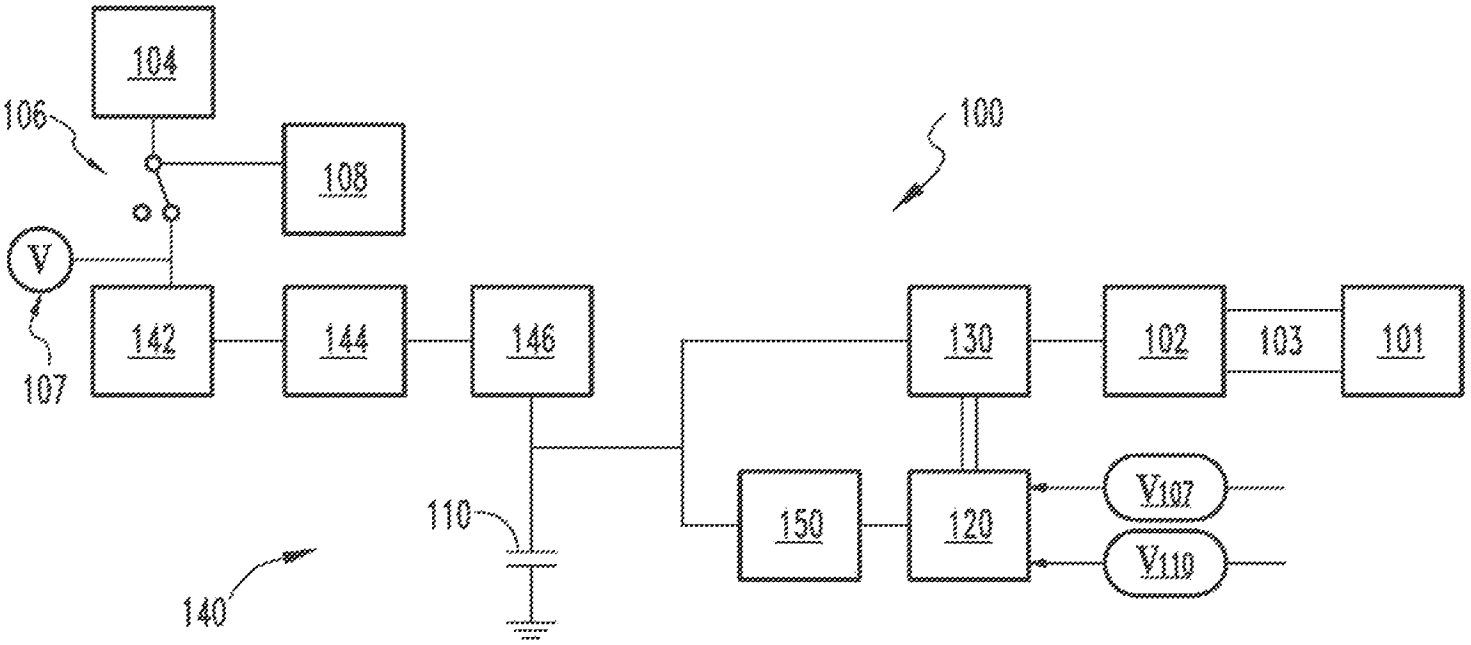
FIG. 1 is a schematic block diagram of an access control system according to an embodiment of the invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Electronic lock systems can be configured in a fail-safe mode or a fail-secure mode. In the fail-safe mode the lock will either remain unlocked or move to an unlocked position when electric power is lost due to an electric power supply outage. The fail-safe mode can also be referred to as electric lock (EL) mode, because electric power must be supplied to move the electronic lock to a locked position. The fail-secure mode can also be referred to as electric unlock (EU)

mode, because electric power must be supplied to move the electronic lock to an unlocked position. The present disclosure provides an apparatus and method to selectively change an electronic lock between an EL mode and an EU mode as desired without requiring disassembly of portions of the lock apparatus, accessing and manipulating internal lock components, the use of tools and/or specialized knowledge and skill of one skilled in the art such as a locksmith. In one aspect, a toggle switch can provide EL or EU selection signals to a controller such as a microcontroller associated with a printed circuit board (PCB) in the electronic lock. The switch can send a relative low signal or a relative high signal to the microcontroller. Depending on the state of the signal, the microcontroller will change the drive command to an electronic actuator upon electric power removal from the system regardless of the cause of the electric power supply failure. In another aspect an electronic switch can be configured to communicate with a controller and other electronic components associated with a printed circuit board (PCB) or the like to change the function between the EL and EU modes as desired. Various electronic lock configurations are disclosed herein as representing exemplary embodiments of the present disclosure, however it should be understood that other electronic lock configurations including, but not limited to cylindrical, tubular and mortise lock platforms are contemplated as falling within the teachings and claims herein as one skilled in the art would readily understand.

FIG. 1 is a block diagram depicting an exemplary access control system 100 configured to permit or deny access to a space such as a closet, room, or building. The system 100 is operable in an unlocked state wherein access to the space is permitted, and a locked state wherein access to the space is prevented. The system 100 includes a locking member 101 operable in a locking position wherein the system 100 is in the locked state, and an unlocking position wherein the system 100 is in the unlocked state. The system 100 also includes an electromechanical actuator or motor 102 coupled to the locking member 101 via a motor shaft 103. The motor 102 is operable to drive the motor shaft 103 to move the locking member 101 between the locking and unlocking positions. In the illustrated form, the motor shaft 103 is directly coupled to the locking member 101, although it is also contemplated that the motor shaft 103 may be connected to the locking member 101 via additional motion-translating members. Illustrative examples of the latter form of connection are described below with respect to FIGS. 3 and 4.

The motor 102 is a reversible motor operable in a first mode and a second mode. In the first mode, the motor 102 drives the motor shaft 103 in a first direction, thereby urging the locking member 101 toward one of the locking and unlocking positions. In the second mode, the motor 102 drives the motor shaft 103 in a second direction, thereby urging the locking member 101 toward the other of the locking and unlocking positions. In the illustrated form, the motor 101 is a direct current (DC) rotary motor, and the first and second directions are rotational directions. In certain forms, the motor 102 may be a DC stepper motor operable to drive the motor shaft 103 in the first rotational direction when receiving DC power of a first polarity, and to drive the motor shaft 103 in the second rotational direction when receiving DC power of an opposite polarity. While the illustrated motor 102 is a rotary motor, other forms of electromechanical actuators/drivers are contemplated, such as rack and pinion linear actuators, geared designs using chains or belts, linear motor actuators, or other types of motion control systems. Such alternatives may also be designed with or without stepping motors.

The system 100 receives electrical power from a power supply 104. In the illustrated embodiment, the power supply 104 is an alternating current (AC) power supply, although it is also contemplated that a DC power supply may be employed. The system 100 is in selective electrical communication with the power supply 104, for example via a switch 106. While the illustrated switch 106 is a single pole, double throw (SPDT) switch, other forms of switch are contemplated. For example, in certain forms, the switch 106 may include a transistor such as a metal-oxide-semiconductor field-effect transistor (MOSFET). The switch 106 is operable in a connecting state wherein the system 100 is electrically coupled with the power supply 104, and a disconnecting state wherein the system 100 is not electrically coupled with the power supply 104. The switch 106 is configured to transition between the connecting and disconnecting states in response to a signal, for example from a user interface 108. The system 100 may further include a voltage sensor 107 configured to sense the voltage $V_{107}$ of power being supplied to the system by the power supply 104.

The system 100 includes an energy storage device or capacitor 110 configured to selectively accumulate and discharge electrical energy, a controller 120, a motor driver 130 which selectively transmits power to the motor 102 in response to commands or signals from the controller 120, and a capacitor charging circuit 140 configured to provide power to the capacitor 110 from the power supply 104. The system 100 may further include a low-dropout (LDO) regulator 150 configured to provide power at a relatively constant voltage to the controller 120.

The energy storage device 110 is of the high-energy-density type, and may, for example, comprise an electric double-layer capacitor (EDLC). These types of capacitors are occasionally referred to as "super-capacitors" or "ultra-capacitors". In some forms, the energy storage device can also include or solely comprise one or more batteries of a rechargeable or a non-rechargeable configuration. In other forms, the energy storage device 110 can include other electrical energy storage devices as would be known to those skilled in the art.

The controller 120 receives data indicative of the supplied power voltage level $V_{107}$ and data indicative of the capacitor voltage level $V_{110}$. The system 100 may include sensors configured to sense the supplied voltage $V_{107}$ and the capacitor voltage Vim, and analogue-to-digital converters (ADCs) (not illustrated) may provide data indicative of the voltage levels $V_{107}$, $V_{110}$ to the controller 120. As discussed in further detail below, the controller 120 compares the voltage level data $V_{107}$, $V_{110}$ to threshold values, and issues commands or signals to the motor driver 130 in response to the comparing.

In certain forms, the system 100 may be selectively operable in a fail-safe or electric locking (EL) mode and in a fail-secure or electric unlocking (EU) mode. To provide EL/EU selection, the controller 120 may include a selector (not illustrated) operable to select between the EL and EU modes. In certain embodiments, the selector may be, for example, of the type described in the commonly-owned U.S. patent application Ser. No. 14/189,476, the contents of which are hereby incorporated by reference in their entirety. In other embodiments, EL/EU selection may be performed digitally, for example via a command sent to the controller 120.

The motor driver 130 receives commands or signals issued by the controller 120, and activates the motor 102 in response to the commands. The motor driver 130 is configured to operate the motor 102 in the first mode in response to a first command, to operate the motor 102 in the second mode in response to a second command, and may further be configured to not operate the motor 102 in response to a third command. For example, in response to an UNLOCK command, the motor driver 130 may supply power of a first polarity to the motor 102, thereby activating the motor 102 in the first mode, moving the motor shaft 103 in the first direction, and urging the locking member 101 from the locking position toward the unlocking position. In response to a LOCK command, the motor driver 130 may provide power of a second, opposite polarity, thereby activating the motor 102 in the second mode, moving the motor shaft 103 in the second direction, and urging the locking member 101 from the unlocking position toward the locking position. The motor driver 130 may prevent power from being supplied to the motor 102 in response to a WAIT command, or alternatively, if neither the UNLOCK nor the LOCK command/signal is being issued.

The exemplary capacitor charging circuit 140 includes a rectifier 142, a buck converter 144, and a current regulator 146. During operation, the rectifier 142 converts AC power from the power supply 104 to DC power, the buck converter 144 outputs DC power of a substantially constant voltage, and the current regulator 146 regulates the DC power to a substantially constant current. While operating conditions limit the current that can be drawn from the power supply 104, by conditioning the power received from the power supply 104, the output current used to charge the capacitor 110 can be much higher than the current drawn from the power supply 104.

By regulating both the current and voltage, power may be supplied to the capacitor 110 at an optimal, substantially constant wattage. This control method maximizes the efficiency of the charging while simultaneously reducing the amount of time required to fully charge the capacitor 110. By way of non-limiting example, if 12V and 500 mA is available from the power supply 104, there is 6 W available from the power supply. The capacitor 110 may only be rated to 5V, but due to the power conditioning provided by the capacitor charging circuit 140, the capacitor 110 may be charged to 5V at 1.2 A (or 6 W).

The schematic flow diagram and related description which follows provides an illustrative embodiment of performing procedures of controlling an access control system such as that shown in FIG. 1. Operations illustrated are understood to be exemplary only, and operations may be combined or divided, and added or removed, as well as re-ordered in whole or part, unless stated explicitly to the contrary herein. Certain operations illustrated may be implemented by a computer executing a computer program product on a non-transient computer readable storage medium, where the computer program product comprises instructions causing the computer to execute one or more of the operations, or to issue commands to other devices to execute one or more of the operations.

Figure 2:
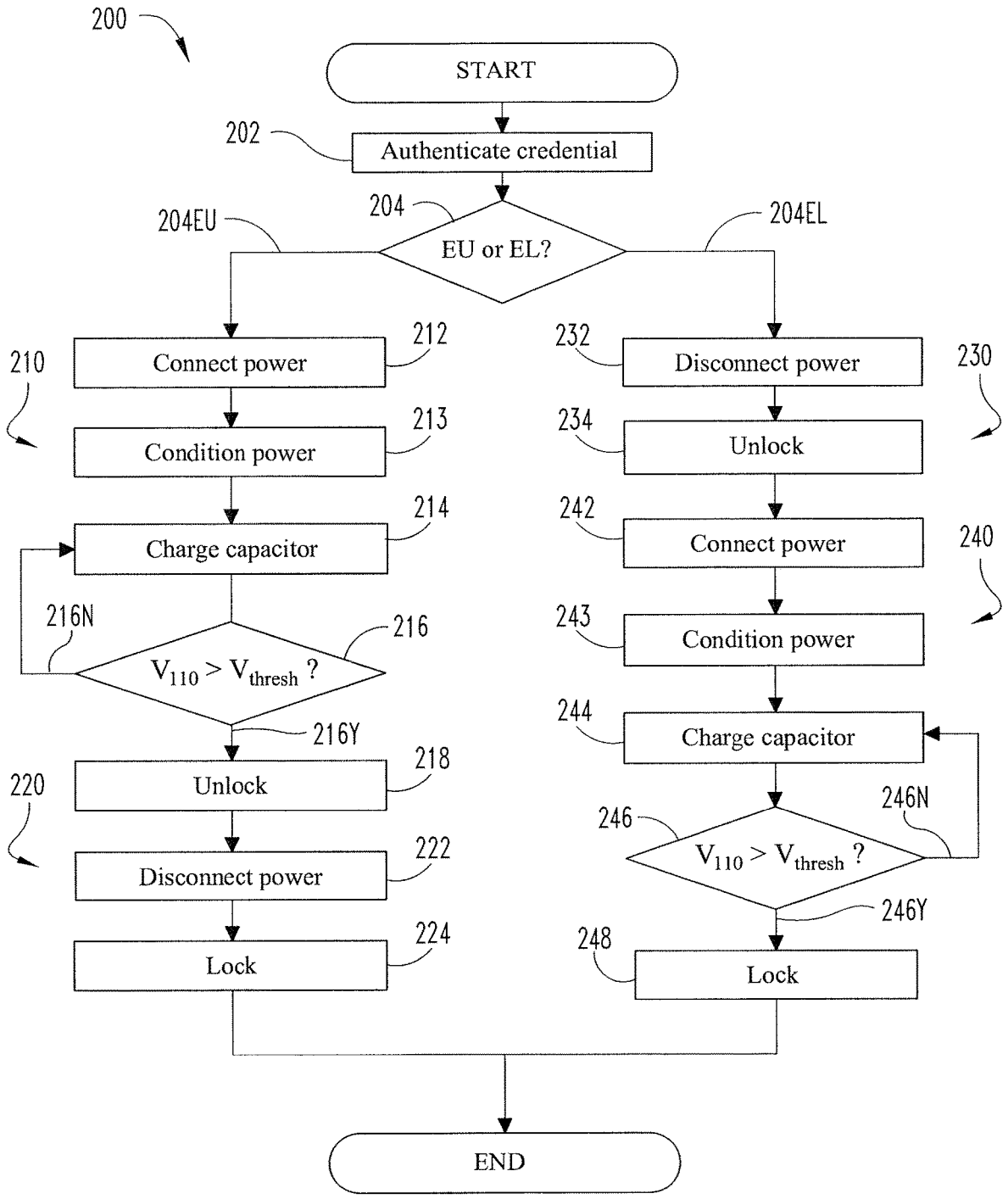
FIG. 2 is a schematic flow chart of a process of operating an access control system.

With reference to FIGS. 1 and 2, the exemplary process 200 begins with an operation 202, which includes authenticating a user credential such as an authentication code, keycard, key fob, or biometric credential. The operation 202 may be performed by the user interface 108, which may, for example, receive the credential via a data line, a radio signal, or a near-field communication method. When the credential is authenticated, the process 200 continues to an operation 204, which includes determining whether the system 100 is operating in the EU mode or the EL mode. If the system 100 is operating in the EU mode, the process 200 continues 204EU to an EU operation. If the system 100 is operating in the EL mode, the process 200 continues 204EL to an EL operation.

The EU operation includes an EU power-on operation 210 during which the system 100 is set to the unlocked state, followed by an EU power-off operation 220 during which the system 100 is set to the locked state. The EU power-on operation 210 begins with an operation 212, which includes connecting the power supply 104 to the system 100. The operation 212 may be performed, for example, by transitioning the switch 106 from the disconnecting state to the connecting state.

The EU power-on operation 210 then proceeds to an operation 213, which includes conditioning the power, for example with the capacitor charging circuit 140. When the power supply is an AC power supply, the operation 213 may include converting the AC power to DC power such as with the rectifier 142. The operation 213 may further include reducing the voltage of the power such as with the buck converter 144, and/or regulating the current of the power such that the power is of a constant wattage or constant amperage, such as with the current regulator 146.

The EU power-on operation 210 then proceeds to an operation 214 which includes charging the capacitor 110 with the conditioned power. The EU power-on operation 210 then proceeds to an operation 216, which includes determining whether the capacitor voltage $V_{110}$ is greater than a threshold capacitor voltage $V_{thresh}$. If the capacitor voltage $V_{110}$ does not exceed the threshold capacitor voltage $V_{thresh}$, the EU power-on operation 210 returns 216N to the operation 214 to continue charging the capacitor 110.

If the capacitor charge $V_{110}$ does exceed the threshold capacitor voltage $V_{thresh}$, the EU power-on operation 210 continues 216Y to an operation 218, which includes unlocking the system 100. The operation 218 may include issuing, with the controller 120, the UNLOCK command or signal to the motor driver 130. In response to the UNLOCK command, the motor driver 130 provides power of a first polarity to the motor 102. As a result of receiving the first polarity power via the motor driver 130, the motor 102 is activated in the first mode. In the first mode of the motor 102, the motor shaft 103 urges the locking member 101 from the locking position toward the unlocking position, thereby transitioning the system 100 from the locked state to the unlocked state.

Once the unlock operation 218 is complete, the EU operation proceeds to the EU power-off operation 220. The EU power-off operation 220 begins with an operation 222, which includes disconnecting the power supply 104 from the system 100, for example by transitioning the switch 106 from the connecting state to the disconnecting state.

The EU power-off operation 220 then proceeds to an operation 224, which includes locking the system 100 in response to the disconnection of power. The operation 224 may include sensing the supplied-power voltage $V_{107}$, comparing the supplied-power voltage $V_{107}$ to a threshold supply voltage indicative of power failure, and determining a no-power condition when the supplied-power voltage $V_{107}$ falls below the threshold supply voltage. The operation 224 may further include determining a power-good condition when the supplied-power voltage $V_{107}$ is greater than or equal to the threshold supply voltage. The operation 224 may further include monitoring the amount of time that has elapsed since the unlocking operation 218, comparing the elapsed time to a threshold unlocking time, and determining a timing condition when the elapsed time exceeds the threshold unlocking time. The operation 224 may further include issuing, with the controller 120, a LOCK command to the motor driver 130 in response to one or more of the conditions. In certain forms, the LOCK command may be issued in response to the timing condition, and the no-power condition may be ignored. In other forms, the LOCK command may be issued in response to the earliest occurrence of the timing condition and the no-power condition.

In response to the LOCK command, the motor driver 130 draws power from the capacitor 110, and provides power of a second, opposite polarity to the motor 102. In the illustrated form, the motor driver 130 draws the power directly from the capacitor 110 with no intervening power conditioning, to eliminate losses that may be caused by certain types of regulation. It is also contemplated that additional power conditioning elements—such as a buck converter, a boost converter, or a buck/boost converter—may condition the power from the capacitor 110 prior to providing the power to the motor driver 130. As a result of receiving the second-polarity power via the motor driver 130, the motor 102 is activated in the second mode, and urges the locking member 101 from the unlocking position to the locking position. Once the locking member 101 is in the locking position, the system 100 is in the locked state, and the EU operation is complete.

The EL operation includes an EL power-off operation 230 during which the system 100 is set to the unlocked state, followed by an EL power-on operation 240 during which the system 100 is set to the locked state. The EL power-off operation 230 is substantially similar to the EU power-off operation 220, and the EL power-on operation 240 is substantially similar to the EU power-on operation 210. In the interest of conciseness, the following description focuses primarily on the differences between the operations 230, 240 and the operations 220, 210.

In contrast to the EU power-off operation 220, which includes the locking operation 224, the EL power-off operation 230 includes an unlocking operation 234. The operation 234 may include determining a no-power condition as described with reference to the operation 224, and issuing, with the controller 120, the UNLOCK command to the motor driver 130 in response to the no-power condition. In response to the UNLOCK command, the motor driver 130 draws power from the capacitor 110, and powers the motor 102 in the manner described with reference to the unlocking operation 218. However, because the power supply 104 is disconnected from the system 100 in the preceding operation 232, the power utilized in the operation 234 is supplied entirely by the capacitor 110.

In contrast to the EU power-on operation 210, which includes the unlocking operation 218, the EL power-on operation 240 includes a locking operation 248. The operation 248 may include determining a timing condition and/or determining a no-power condition as described with reference to the operation 224. The operation 248 may further include issuing the LOCK command in response to presence of the timing condition and absence of the no-power condition. In response to the LOCK command, the motor driver 130 supplies the motor 102 with inverted-polarity power in the manner described with reference to the locking operation 224. Because the power supply 104 was connected to the system 100 in the preceding operation 242, the power utilized in the operation 242 is supplied by the power supply 104 and the capacitor 110, which are connected to the motor driver 130 in parallel fashion. While the power is nominally supplied from both the power supply 104 and the capacitor 110, the operation 242 does not appreciably deplete the charge stored in the capacitor 110, as any discharge from the capacitor 110 results in additional charging of the capacitor 110. Once the operation 248 is complete, the system 100 is in the locked state, and the EL operation is complete.

While the above-described power-off operations 220, 230 include intentionally disconnecting the power supply 104 from the system 100, those having skill in the art will recognize that should the power supply 104 be interrupted—for example due to a power failure—the power-off operations 220, 230 will nonetheless function in the same manner.

If the system 100 is operating in the EU mode and power is removed when the system 100 is in the unlocked state, the controller 120 senses the no-power condition and issues the LOCK command. In response, the motor driver 130 drives the motor 102 with power from the capacitor 110 to urge the locking member 101 to the locking position. Because the system 100 is in the locked state after the power failure, the system 100 has "failed secure".

Similarly, if the system 100 is operating in the EL mode and power is removed when the system 100 is in the locked state, the controller 120 senses the no-power condition and issues the UNLOCK command. In response, the motor driver 130 drives the motor 102 with power from the capacitor 110 to urge the locking member 101 to the unlocking position. Because the system 100 is in the unlocked state after the power failure, the system 100 has "failed safe".

As is evident from the foregoing, when power is removed from the system 100—either intentionally or unintentionally—the motor 102 is driven entirely by power from the capacitor 110. If the charge in the capacitor 110 less than a threshold charge sufficient to drive the motor 102 for the amount of time required to move the locking member 101 between the locking position and the unlocking position, the system 100 may fail to transition to the appropriate state. The threshold charge may of course vary from system to system according to a number of factors, such as the power requirements of the motor 102, current leakage from elements such as the motor driver 130, operating conditions, and factors of safety.

As is known in the art, the charge stored on a capacitor can be calculated using the equation $E=\frac{1}{2}CV^2$, where E is the energy or charge, C is the capacitance, and V is the voltage. Accordingly, given a threshold charge $E_{thresh}$ and the capacitance $C_{110}$ of the capacitor 110, a threshold capacitor voltage $V_{thresh}$ can be calculated as $$V_{thresh} = \sqrt{\frac{2E_{thresh}}{C_{110}}}.$$

Given a particular system and a set of expected operating parameters, a worst-case threshold charge can be calculated as the threshold charge of the system for the most adverse expected operating conditions under which the system 100 is expected to operate. In certain forms, the threshold capacitor voltage $V_{thresh}$ is selected as the voltage of the capacitor 110 when storing the worst-case threshold charge. Such a capacitor is large enough (and has a high enough operating voltage) to store enough energy to operate the system 100, but still small enough to maximize the amount of potential stored. A smaller capacitor may not be able to store enough energy where a larger capacitor would not charge as quickly. In this manner, the capacitor 110 can be selected to have the lowest capacitance necessary to perform the required functions, reducing the size and cost of the capacitor 110.

In certain embodiments, the threshold charge $E_{thresh}$ may be selected as the amount of charge required to drive the locking member 101 between the locked and unlocked states under standard operating conditions, plus a predetermined factor of safety. The factor of safety may be selected from among a plurality of ranges having varying minima and maxima. By way of non-limiting example such ranges may include a minimum selected from the group consisting of 10%, 20%, 30%, and 40%, and a maximum selected from the group consisting of 40%, 50%, 60%, and 70%.

By selecting a threshold capacitor charge $E_{thresh}$ according to one of the above methods, the capacitor 110 may be selected as an EDLC with a relatively small capacitance (for example, on the order of 1 mF to 100 mF). In certain embodiments, the capacitor 110 may be selected with a capacitance from about 10 mF to about 80 mF, from about 50 mF to about 70 mF, from about 30 mF to about 50 mF, or from about 15 mF to about 30 mF. In such embodiments, performing one of the power-off operations 220, 230 under standard conditions may include discharging the capacitor 110 to a predetermined percentage of the threshold capacitor voltage $V_{thresh}$, and performing one of the power-off operations 220, 230 under the most adverse expected operating conditions may include discharging the capacitor 110 to a substantially depleted state.

It is also contemplated that the capacitor 110 may be selected with a greater capacitance, for example to enable the system 110 to perform multiple lock/unlock cycles without reconnecting to the power supply 104. In such embodiments, the capacitor 110 may be selected as an EDLC with a relatively large capacitance (for example, greater than 1 F). During initial start-up of such systems the capacitor 110 may need to be connected to the power for a predetermined time, in order to build up enough charge to perform the multiple lock/unlock cycles. In certain embodiments of this type, the capacitor 110 may be selected with a capacitance from about 1 F to about 5 F, or from about 1.5 F to about 2.5 F.

As can be seen from the foregoing description, the inventive system 100 and process 200 provide a number of significant advantages over conventional systems. For example, during the power-on operations 210, 240, the power conditioning performed by the capacitor charging circuit 140 allows for rapid charging of the capacitor 110, while reducing the current that must be drawn from the power supply 104. Additionally, during the operations 210, 240, the system 100 draws very little power from the power supply 104 after the locking member 101 has been moved to the appropriate locking or unlocking position. Contrastingly, conventional solenoid-based systems require constant application of power to remain in one of the locking and unlocking positions. This reduction in power usage during the power-on operations 210, 240 is particularly advantageous when operating in the EL mode, wherein power must be supplied to the system 100 to retain the system in the locked state.

Figure 3:
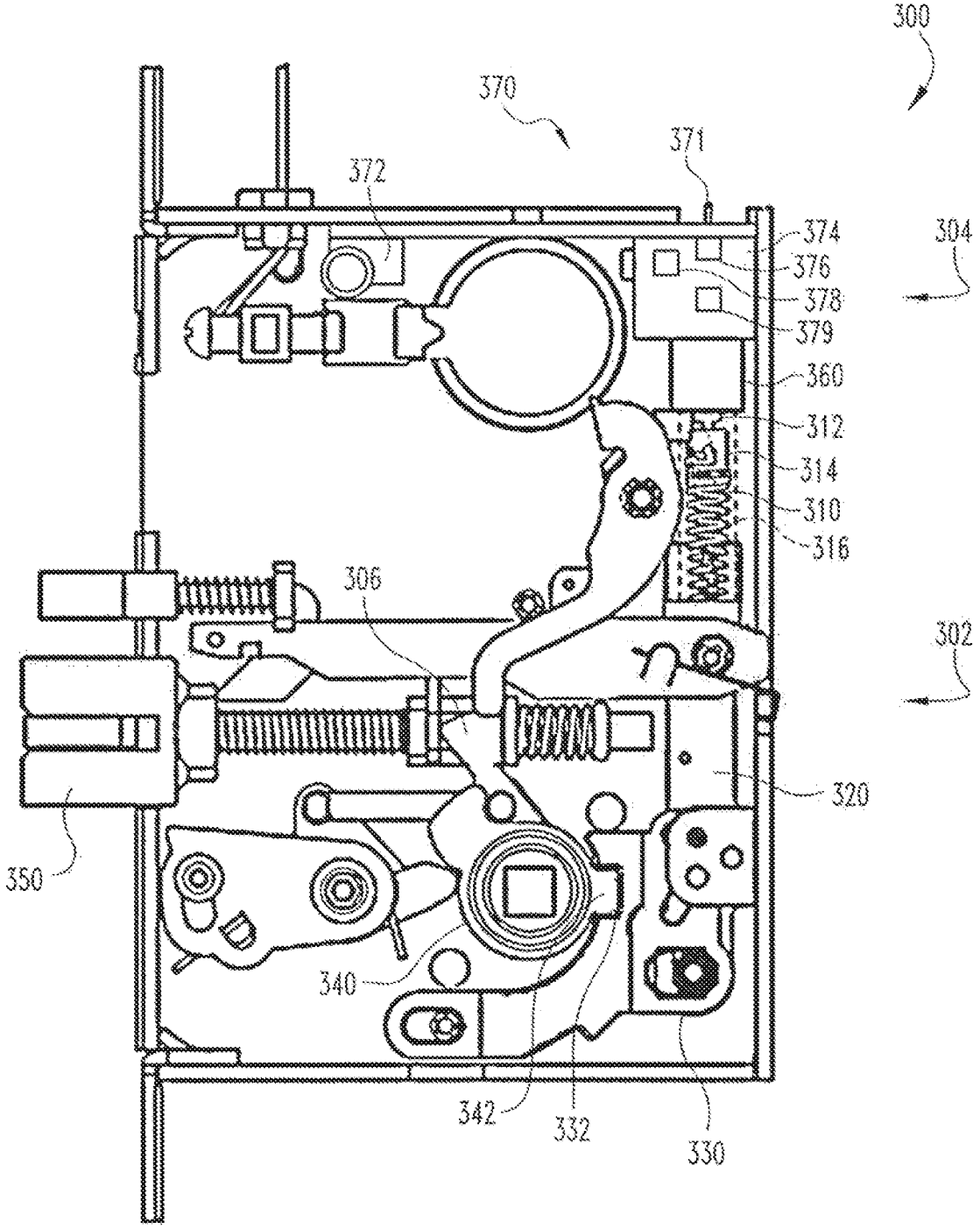
FIG. 3 depicts a mortise lock assembly according to an embodiment of the invention.
Figure 4:
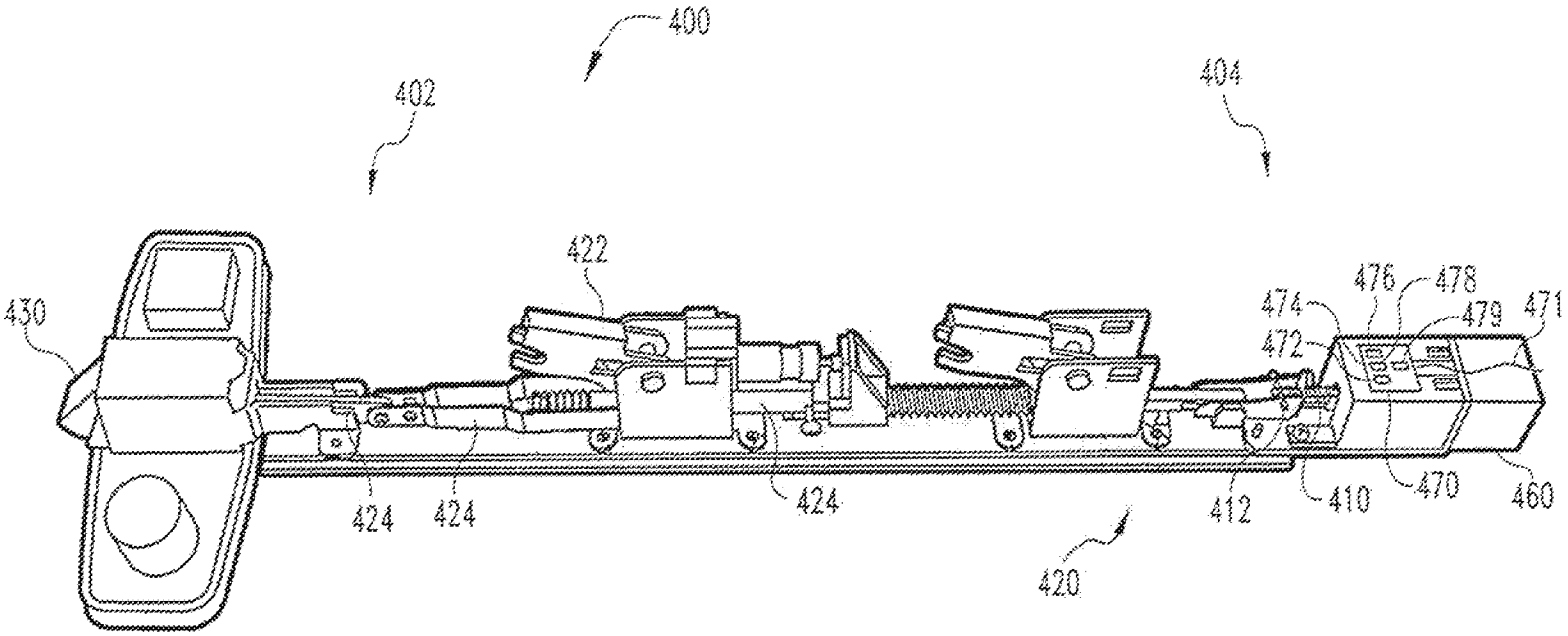
FIG. 4 illustrates a push-bar lock assembly according to an embodiment of the invention.

FIGS. 3 and 4 depict illustrative forms of locking assemblies 300, 400 which include certain features similar to those described above with reference to the access control system 100, and may be operable by a process similar to the above-described process 200. While the embodiments described hereinafter may not specifically describe features analogous to those described above, such as the LDO regulator 150, such features may nonetheless be employed in connection with the described systems.

FIG. 3 depicts an electrically operable mortise assembly 300, for example of the type described in the commonly-owned U.S. Pat. No. 5,628,216 to Qureshi et al., the contents of which are hereby incorporated by reference in their entirety. The mortise lock 300 includes a locking assembly 302 operable in locked and unlocked states, and a drive assembly 304 operable to transition the locking assembly 302 between the locked and unlocked states.

The locking assembly 302 includes a helical member or spring 310, a link 320 operably connected with the spring 310, a locking member or catch 330 operably connected with the link 320, a hub 340 rotationally coupled with a spindle (not illustrated), which is rotationally coupled with an outer handle (not illustrated), and a latch bolt 350 operably connected with the hub 340. The drive assembly 304 includes an electromechanical actuator or motor 360, and a control system 370 configured to control operation of the motor 360.

When the locking assembly 302 is in the unlocked state, the hub 340 is free to rotate. Rotation of the outer handle rotates a locking lever 306 via the hub 340, which in turn retracts the latch bolt 350. When the locking assembly 302 is in the locked state, the catch 330 engages the hub 340, thereby preventing the hub 340 from rotating. This arrangement is known in the art, and need not be further described herein.

The spring 310 is coupled to an output shaft 312 of the motor 360 by way of a coupler 314, such that rotation of the shaft 312 causes rotation of the spring 310. The locking assembly 302 may further include a casing 316 (illustrated in phantom) to protect the spring 310 during operation of the lock 300.

The link 320 is operably connected to the spring 310 such that rotation of the spring 310 in a first rotational direction urges the link 320 in a first linear direction, and rotation of the spring 310 in a second rotational direction urges the link 320 in a second linear direction. The connection may be formed, for example, by a pin coupled to the link 320 and extending through the spring 310 as disclosed in the Qureshi patent, although other forms of connection are contemplated.

The catch 330 is operable in a locking position (FIG. 3) and an unlocking position (not illustrated). In the locking position of the catch 330, a recess 332 on the catch 330 engages a protrusion 342 on the hub, the hub 340 is prevented from rotating, and the locking assembly 302 is in the locked state. In the unlocking position of the catch 330, the recess 332 does not engage the protrusion 342, the hub 340 is free to rotate, and the locking assembly 302 is in the unlocked state.

The catch 330 is operably coupled to the link 320 such that movement of the link 320 in the first linear direction urges the catch 330 toward either the locking or the unlocking position, and movement of the link 320 in the second linear direction urges the catch 330 toward the other position. In the illustrated embodiment, movement of the link 320 in either the first or second direction is substantially perpendicular to the motion of the catch 330 between the locking and unlocking positions. It is also contemplated that the link 320 and the catch 330 may move in substantially the same direction, substantially opposite directions, at an oblique angle to one another, or that the motion of one or more of the link 320 and the catch 330 may be a pivoting motion.

The motor 360 is operable to rotate the motor shaft 312 in either of the first rotational direction and the second rotational direction, thereby rotating the spring 310 in a corresponding direction. As described above, this motion urges the link 320 in a corresponding direction, which in turn urges the catch 330 toward one of the locking and unlocking positions. The motor 360 may be substantially similar to the previously-described motor 102, and may include features such as those described with respect to the illustrated and alternative embodiments of the motor 102, such as an electric linear actuator or the like.

The control system 370 receives electrical power from a power supply (not illustrated) via a power inlet 371, and includes a capacitor 372, and a printed circuit board (PCB) 374 having mounted thereon a controller 376, a motor driver 378, and a capacitor charging circuit 379. The capacitor 372, controller 376, motor driver 378, and capacitor charging circuit 379 may be substantially similar to the capacitor 110, controller 120, motor driver 130, and capacitor charging circuit 140 described above, and may include features such as those described above with respect to the illustrated and alternative embodiments of the corresponding elements.

When the mortise lock 300 is operated according to the process 200, the capacitor charging circuit 379 receives power via the power inlet 371, conditions the power, and charges the capacitor 372 with the conditioned power. The controller 376 monitors the voltage of the capacitor 372, and compares the capacitor voltage to a threshold capacitor voltage as described above. When the capacitor voltage meets or exceeds the threshold capacitor voltage, the controller 374 issues a first command or signal to the motor driver 378. The controller 376 also monitors the voltage of the power inlet 371, and compares the power inlet voltage to a threshold power failure voltage. When the power inlet voltage falls below the threshold power failure voltage, the controller 374 issues a second command to the motor driver 378. When the mortise lock 300 is operating in an EL mode, the first command is a LOCK command, and the second command is an UNLOCK command. When the mortise lock 300 is operating in an EU mode, the first command is an UNLOCK command, and the second command is a LOCK command.

In response to the UNLOCK command, the motor driver 378 powers the motor 360 with power of a first polarity. In response, the motor 360 operates in a first state, and drives the motor shaft 312—and thereby the spring 310—in a first rotational direction. Rotation of the spring 310 in the first rotational direction urges the link 320 in a first linear direction. If the link 320 is blocked from moving in the first linear direction, the spring 310 elastically deforms, which results in a biasing force urging the link 320 in the first linear direction. When the link 320 is free to move in the first linear direction, such movement causes the catch 330 to move to the unlocking position.

In response to the LOCK command, the motor driver 378 powers the motor 360 with power of a second, opposite polarity. In response, the motor 360 operates in a second state, and drives the motor shaft 312—and thereby the spring 310—in a second rotational direction. Rotation of the spring 310 in the second rotational direction urges the link 320 in a second linear direction. If the link 320 is blocked from moving in the second linear direction, the spring 310 elastically deforms, which results in a biasing force urging the link 320 in the second linear direction. When the link 320 is free to move in the second linear direction, such movement causes the catch 330 to move to the locking position.

FIG. 4 depicts an electrically operable pushbar assembly 400, for example of the type described in the commonly-owned U.S. Pat. No. 8,182,003 to Dye et al., the contents of which are hereby incorporated by reference in their entirety. The pushbar assembly 400 includes a locking assembly 402 operable in an unlocked state and a locked state, and a drive assembly 404 operable to transition the locking assembly 402 between the locked state and the unlocked state.

The locking assembly 402 includes a helical member or threaded motor shaft 410, a linkage assembly 420 operably connected with the motor shaft 410, and a locking member or latch bolt 430 operably connected with the linking assembly 420. The drive assembly 404 includes an electromechanical actuator or motor 460, and a control system 470 configured to control operation of the motor 460.

The pushbar assembly 400 can be operated either manually or electrically. During manual operation, a user presses inward on a pushbar (not illustrated); this motion is transmitted via bell cranks 422 to linking rods 424 of the linking assembly 420, which in turn retracts the latch bolt 430. During electrical operation, power is supplied to the motor 460 via the control system 470 to rotate a nut (not illustrated) including internal threads which engage external threads of the motor shaft 410. The motor shaft 310 is restrained from rotational displacement by a pin 411; during rotation of the nut, the engagement of the threads causes the motor shaft 410 to retract toward the motor 460 in a first linear direction. This motion is transferred via the linkage assembly 420 to the latch bolt 430 to retract the latch bolt 430 to an unlocking position. When the motor 460 is de-energized, return springs urge the linking assembly 420 in a second, opposite linear direction to extend the latch bolt 430 to a locking position. Such operations are known in the art, and need not be further described herein.

The control system 470 receives electrical power from a power supply (not illustrated) via a power inlet 471, and includes a capacitor 472 and a printed circuit board (PCB) 474 having mounted thereon a controller 476, a motor driver 478, and a capacitor charging circuit 479. The capacitor 472, controller 476, motor driver 478, and capacitor charging circuit 479 may be substantially similar to the capacitor 110, controller 120, motor driver 130, and capacitor charging circuit 140 described above, and may include features such as those described above with respect to the illustrated and alternative embodiments of the corresponding elements.

When the pushbar assembly 400 is operated according to the process 200, the capacitor charging circuit 479 receives power via the power inlet 471, conditions the power, and charges the capacitor 472 with the conditioned power. The controller 476 monitors the voltage of the capacitor 472, and compares the capacitor voltage to a threshold capacitor voltage as described above. When the capacitor voltage meets or exceeds the threshold capacitor voltage, the controller 474 issues a first command to the motor driver 478. The controller 476 also monitors the voltage of the power inlet 471, and compares the power inlet voltage to a threshold power failure voltage. When the power inlet voltage falls below the threshold power failure voltage, the controller 474 issues a second command to the motor driver 478 and a third command to a dogging assembly (not illustrated). When the pushbar assembly 400 is operating in an EL mode, the first command is a LOCK command, and the second command is an UNLOCK command. When the pushbar assembly 400 is operating in an EU mode, the first command is an UNLOCK command, and the second command is a LOCK command.

In response to the UNLOCK command, the motor driver 478 powers the motor 460 to retract the motor shaft 410 in the first linear direction. Movement of the motor shaft 410 in the first linear direction urges the linking assembly 420 in the first linear direction, which in turn retracts the latch bolt 430 to the unlocking position. In response to the LOCK command, the motor driver 478 disconnects power from the motor 460, and the return springs urge the linking assembly 420 and the motor shaft 410 in the second linear direction, thereby extending the latch bolt 430 to the locking position. After the motor driver 478 has completed the operation corresponding to the second command, the dogging assembly responds to the third command by engaging the locking assembly 402 to retain the latch bolt 430 in the locking position (when operating in the EU mode) or the unlocking position (when operating in the EL mode).

Figure 5:
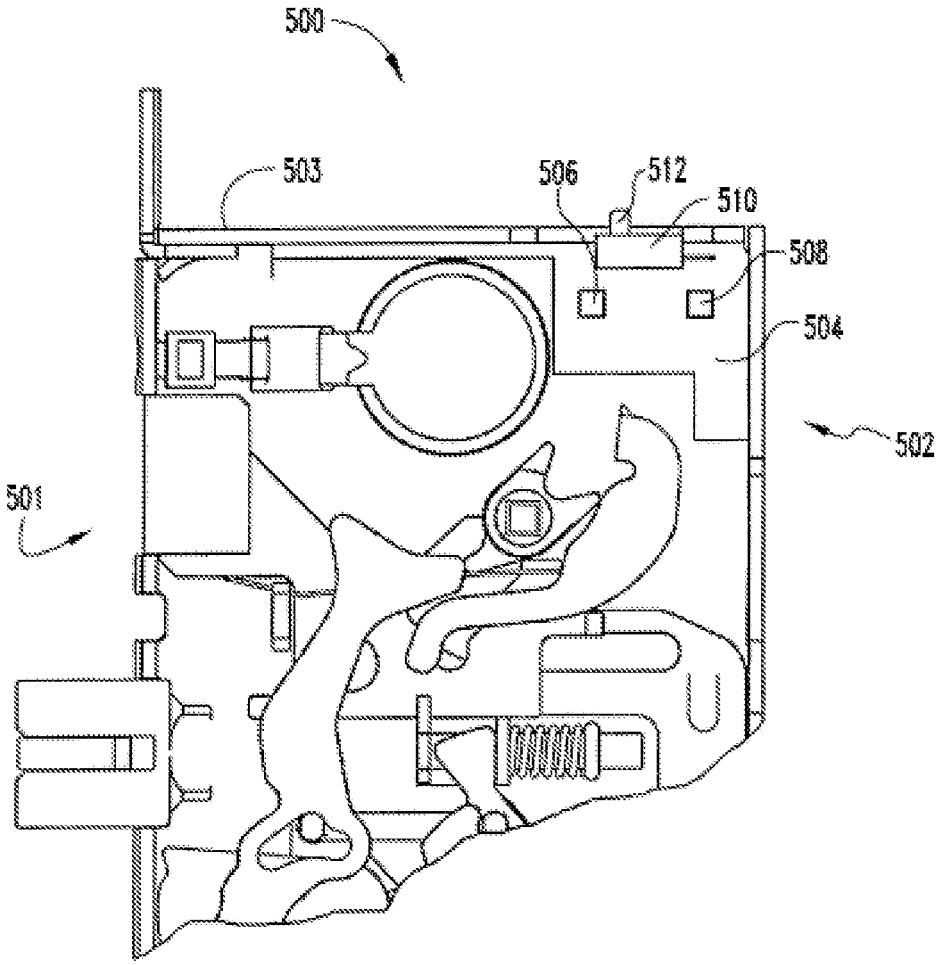
FIG. 5 is a plan view of a portion of another mortise lock assembly having a selectable power off function according to an embodiment of the invention.

Referring now to FIG. 5, an exemplary lock apparatus 500 is illustrated in a system with a selectable power off mechanism 502. In general, lock components 501 shown in the mortise lock 500 will not be discussed as they are common to many types of mechanical and electronic locks or lock mechanisms. It should be understood that the selectable power off mechanism 502 as disclosed herein can be used with any electro-mechanical lock system as would be known to those skilled in the art. A selectable power off mechanism 502 can be operably coupled to the lock components to permit a user such as a typical home owner or business owner to select the power off function of the lock 500 without specialized skill or knowledge. As discussed above, an electronic lock can be configured to operate in one of the EU (electric unlock) or EL (electric lock) modes.

The present disclosure provides for a system that permits selection of the EU mode or EL mode without requiring a skilled artisan or locksmith to open the lock case and remove and/or manipulate internal lock components to change the lock between the EU and EL modes of operation. The lock 500 can include a selectable power off mechanism 502 positioned within a case 503 of the lock 500. The selectable power off mechanism 502 can include a printed circuit board (PCB) 504 having various electronic components 506 including, but not limited to a controller 508 operable for controlling portions of the lock 500. In one form, the power off mechanism 502 can include a selector switch 510 having a switch arm 512 movable between first and second positions corresponding to the EU mode and the EL mode, respectively. In some forms, the selector switch 510 can include more than one switch arm 512 and can be moveable between three or more positions. In one form, the selector switch 510 can be a manual electric switch that can be packaged with others in a group in a standard dual in-line package used on a printed circuit board along with other electronic components commonly known as a "DIP switch," however other types of switches as known to those skilled in the art are contemplated by the present disclosure. In some embodiments the selector switch 510 may include a third position to command the lock 500 to remain in position during an electric power off condition.

Figure 6:
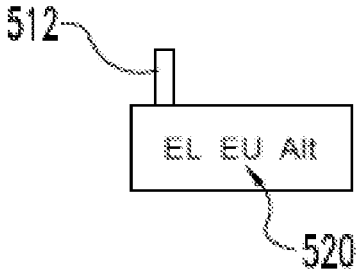
FIG. 6 is a schematic view of a portion of a selector switch.

The switch arm 512 can be positioned anywhere relative to the lock case 503 as desired so as to permit easy access for a user to move the switch arm 512 to a desired position. In some forms, the switch arm 512 can extend out of the case 503 and in other forms the switch arm 512 can be positioned within the outer wall of the case 503 so long as an opening permits access to the switch arm 512 of the selector switch 510. As shown in FIG. 6, the position of the switch arm 512 can be can be identified by any number of visible or tactile means so as to be substantially fool-proof for a typical user. A visible and/or tactile raised display 520 on a portion of the lock 500 can be used to identify the position (EL, EU, or alternate) of the switch arm 512. The display 520 can include words, letters, symbols, graphics, color coding tactile features or other advantageous identification means.

In some forms, the selectable power off mechanism 502 can include an electronic switch in addition to a switch 510 with a selector arm 512. The electronic switch can be activated or controlled through electronic means operable to communicate with the controller 508 and/or other electronic components. An electronic signal can be transmitted to the selectable power off mechanism 502 by a variety of electronic inputs. Such non-limiting examples can include a key code, a key fob, RF (radio frequency) transmitter and/or a near filed proximity transmitter. Other input devices can include computational devices such as smart phones, electronic tablets, or other personal computing devices having a connection through the internet or other direct signal transmitting means as would be known to those skilled in the art. In still other forms the selectable power off mechanism 502 can be solely controlled by an electronic switch in lieu of a switch 510 with a selector arm 512.

In one aspect the present disclosure includes a lock apparatus comprising: a lock housing having a plurality of mechanical and electronic lock components disposed therein; an electronic controller disposed within the lock housing and operable to control a state of the lock between locked and unlocked positions; an electronic actuator electrically coupled to the controller and connected to the lock components, the electronic actuator movable between first and second positions corresponding to a locked position and an unlocked position of the lock, respectively; at least one electrical energy storage device electrically coupled to the controller and the electric actuator; and a selector switch coupled to the controller being operable to define a desired state of the lock as one of an electrically locked (EL) and an electrically unlocked (EU) state in an electric power off condition.

Refining aspects of the present disclosure include the selector switch having a movable arm extending out of the lock housing; wherein the selector switch includes a movable arm that is accessible without removal of the housing or use of specialized tools; wherein the selector switch is movable between first and second positions corresponding to one of the EL and EU states; identification display means to determine the position of the selector switch including one or more words, letters, symbols, graphics, color codes and/or tactile features; wherein the selector switch includes a third position, wherein the controller will prevent the lock from changing states during a power off condition; a driver module that is operable to drive the electric actuator, and wherein the driver module continues to be operable to drive the electronic actuator after an electric power failure; wherein the selector switch includes a DIP switch; wherein the selector switch includes an electronic portion to receive an input signal from an input device and transmit an output signal to the electronic controller; wherein the energy storage device is a battery; wherein the energy storage device is a capacitor; wherein the electronic actuator includes at least one of a rotatable shaft and a linear translatable shaft; and wherein the selector switch is an electronic switch.

Another aspect of the present disclosure includes an electronic lock comprising: a printed circuit board (PCB) having a memory, a microcontroller, and an electrical energy storage device; an electronic actuator operable to move the lock between locked and unlocked positions when a command signal is received from the microcontroller; wherein the microcontroller and electronic actuator receives electrical power from an external power source under a power-on condition and receives electrical power from the electrical energy storage device during a power off condition; and a selector switch configured to send a signal to the microcontroller to set the operating mode of the lock to one of an electric locked (EL) mode and an electric unlocked (EU) mode in a power off condition.

Refining aspects include the selector switch having a movable arm accessible without removing portions of the lock; wherein the selector switch is movable between first and second positions corresponding to one of the EL and EU states; identification display means to determine the position of the selector switch including one or more words, letters, symbols, graphics, color codes and/or tactile features; wherein the selector switch includes a third position, wherein the controller will prevent the lock from changing states during a power off condition; wherein the selector switch includes an electronic portion to receive an input signal from an input device and transmit an output signal to the electronic controller; wherein the energy storage device includes at least one of a battery and a capacitor; and wherein the electronic actuator is one of an electric motor and linear actuator configured to move the lock between locked and unlocked positions; and wherein the selector switch is an electronic switch.

Another aspect of the present disclosure includes a method for controlling a lock under a power off condition comprising: charging an electric energy storage device from an external electric power source; defining, with a selector switch positioned at least partially external to a lock housing, a desired state of the lock member in the power off condition, wherein the desired state includes one of an electrically locked (EL) and an electrically unlocked (EU) state; and moving the lock to the desired state with the energy storage device in a power off condition.

Refining aspects includes accessing the selector switch without removing portions of a lock assembly; delaying the moving of the lock by a predetermined amount of time after a power off condition occurs; and displaying an identification of a position of the selector switch on a portion of the lock.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An access control device having a locked state and an unlocked state, the access control device comprising:

an electromechanical actuator operable to transition the access control device between the locked state and the unlocked state;

an energy storage device operable to store electrical power from a power supply when the power supply is active; and a controller having a fail secure mode and a fail safe mode;

wherein the controller is configured to direct the stored electrical power of the energy storage device to the electromechanical actuator when a voltage level of the power supply falls below a threshold supply voltage, and a charge level of the energy storage device exceeds a threshold charge level;

wherein the controller is configured to direct the electrical power from the power supply to the electromechanical actuator when the voltage level of the electrical power from the power supply satisfies the threshold supply voltage;

wherein, with the controller in the fail secure mode, the electromechanical actuator to transitions the access control device to the locked state; and wherein, with the controller in the fail safe mode, the electromechanical actuator to transitions the access control device to the unlocked state.

2. The access control device of claim 1, wherein the controller is configured to transition between the fail secure mode and the fail safe mode in response to an electronic command.

3. The access control device of claim 1, further comprising a electronic switch operable in two or more positions to transition the controller between the fail secure mode and the fail safe mode.

4. The access control device of claim 3, wherein the electronic switch is further operable in one of the two or more positions to cause the access control device to remain in the locked state or the unlocked state during an electric power off condition.

5. The access control device of claim 1, wherein the controller is configured to selectively prevent the stored electrical power of the energy storage device from being supplied to the electromechanical actuator such that the access control device does not transition between the locked state and the unlocked state.

6. The access control device of claim 1, further comprising a three-position electronic switch operable to transition the controller between the fail secure mode when the switch is in a first position, the fail safe mode when the switch is in a second position, and to cause the access control device to remain in the locked state or the unlocked state during an electric power off condition when the switch is in a third position.

7. An access control device having a locked state and an unlocked state, the access control device comprising:

an electromechanical actuator operable to transition the access control device between the locked state and the unlocked state;

an energy storage device operable to store electrical power from a power supply when the power supply is active; and controller having a fail secure mode and a fail safe mode;

wherein the controller is configured to direct the stored electrical power from the energy storage device to the electromechanical actuator in a first power condition when a voltage level of the power supply falls below a threshold supply voltage, and a charge level of the energy storage device exceeds a threshold charge level;

wherein, in the first power condition and with the controller in the fail secure mode, the stored electrical power of the energy storage device is configured to cause the electromechanical actuator to transition the access control device to the locked state;

wherein, in the first power condition and with the controller in the fail safe mode, the stored electrical power of the energy storage device is configured to cause the electromechanical actuator to transition the access control device to the unlocked state;

wherein the controller is configured to direct the electrical power from the power supply to the electromechanical actuator in a second power condition when the voltage level of the power supply satisfies the threshold supply voltage;

wherein, in the second power condition and with the controller in the fail secure mode, the electrical power from the power supply causes the electromechanical actuator to transition the access control device to the unlocked state;

wherein, in the second power condition and with the controller in the fail safe mode, the electrical power from the power supply causes the electromechanical actuator to transition the access control device to the locked state.

8. An access control device, comprising:

an electromechanical actuator operable to transition the access control device between a locked state and an unlocked state;

an energy storage device operable to selectively provide electrical power to the electromechanical actuator;

controller connected with the energy storage device; and an electronic switch operable in two or more positons to transition the controller between a fail secure mode and a fail safe mode;

wherein the controller, in the fail secure mode, is configured to direct electrical power from the energy storage device to the electromechanical actuator such that the electromechanical actuator transitions the access control device from the unlocked state to the locked state;

wherein the controller, in the fail safe mode, is configured to direct electrical power from the energy storage device to the electromechanical actuator such that the electromechanical actuator transitions the access control device from the locked state to the unlocked state; and wherein the electronic switch is further operable in one of the two or more positions to cause the access control device to remain in the locked state or the unlocked state during an electric power off condition.

9. The access control device of claim 8, further comprising a lock case in which the electromechanical actuator, the energy storage device, and the controller is housed; and wherein the electronic switch is accessible without opening the lock case.

10. The access control device of claim 8, wherein the access control device further comprising a first indicium relating a first position of the electronic switch to one of the fail secure mode or the fail safe mode.

11. The access control device of claim 10, further comprising a second indicium relating a second position of the electronic switch to the other of the fail secure mode or the fail safe mode.

12. An access control device, comprising:

an electromechanical actuator operable to transition the access control device between a locked state and an unlocked state, wherein the electromechanical actuator is configured to place the access control device in the locked state in response to receiving a locking signal, and wherein the electromechanical actuator is configured to place the access control device in the locked state in response to receiving an unlocking signal;

an energy storage device operable to store electrical power from a power supply when the power supply is active; and controller connected with the energy storage device, wherein the controller is operable to transmit to the electromechanical actuator a first signal in response to a charge of the energy storage device exceeding a threshold charge, wherein the controller is operable to transmit to the electromechanical actuator a second signal in response to a voltage of the power supply falling below a threshold voltage, wherein the first signal comprises electrical power from the power supply, and wherein the second signal comprises electrical power from the energy storage device;

wherein the controller has an electric locking mode in which the first signal is the locking signal and the second signal is the unlocking signal; and wherein the controller has an electric unlocking mode in which the first signal is the unlocking signal and the second signal is the locking signal.

13. The access control device of claim 12, further comprising an electronic switch operable to transition the controller between the electric locking mode and the electric unlocking mode.

14. The access control device of claim 13, further comprising a display configured to indicate to a user the electric locking or electric unlocking mode based upon a position of the electronic switch.

15. The access control device of claim 12, further comprising an electronic switch configured to transition the controller between the electric locking mode and the electric unlocking mode in response to receiving an electronic signal.

* * * * *